United States Patent [19]

Chang

[11] Patent Number: 5,028,503

[45] Date of Patent: Jul. 2, 1991

[54] PHOTOHARDENABLE ELECTROSTATIC ELEMENT WITH IMPROVED BACKTRANSFER CHARACTERISTICS

[75] Inventor: Catherine T. Chang, Wilmington, Del.

[73] Assignee: E. I. Du Pont de Nemours and Company, Wilmington, Del.

[21] Appl. No.: 410,655

[22] Filed: Sep. 21, 1989

[51] Int. Cl.[5] ..... G03C 1/725; G03C 1/73; G03G 15/00

[52] U.S. Cl. ..... 430/281; 430/56; 430/283

[58] Field of Search ..... 430/281

[56] References Cited

U.S. PATENT DOCUMENTS

| | | | |
|---|---|---|---|
| 4,210,711 | 1/1980 | Kitajima et al. | 430/325 X |
| 4,264,710 | 4/1981 | Kondoh et al. | 430/281 |
| 4,347,303 | 8/1982 | Asano et al. | 430/272 |
| 4,351,893 | 9/1982 | Anderson | 430/281 |
| 4,725,518 | 2/1988 | Carmichael et al. | 430/132 |
| 4,732,831 | 3/1988 | Risenfeld et al. | 430/49 |
| 4,732,881 | 3/1988 | Riesenfeld et al. | 430/49 |
| 4,814,246 | 3/1989 | Lehmann et al. | 430/66 |
| 4,818,660 | 4/1989 | Blanchet-Fincher et al. | 430/281 |
| 4,839,314 | 7/1989 | Blanchet-Fincher et al. | 430/49 |

*Primary Examiner*—Marion E. McCamish
*Assistant Examiner*—S. Crossan

[57] ABSTRACT

Photohardenable electrostatic master with improved backtransfer characteristics comprising (1) an electrically conductive substrate, and (2) a layer of photohardenable composition consisting essentially of (a) at least one organic polymeric binder, (b) at least one compound having at least one ethylenically unsaturated group, and (c) a photoinitiator or photoinitiator system, and (d) an acidic additive as defined.

A xeroprinting process is described using the master. The master is used in graphic arts, color proofing which duplicates images produced by printing, preparation of printed circuit boards, resists, soldermasks, etc.

49 Claims, No Drawings

PHOTOHARDENABLE ELECTROSTATIC ELEMENT WITH IMPROVED BACKTRANSFER CHARACTERISTICS

FIELD OF THE INVENTION

This invention relates to a photohardenable electrostatic master for xeroprinting. More particularly this invention relates to a photohardenable electrostatic master having on an electrically conductive substrate a layer of a photohardenable composition which contains an organic polymeric binder, compound having at least one ethylenically unsaturated group, photoinitiator or photoinitiator system, and an acidic additive.

BACKGROUND OF THE INVENTION

Photopolymerizable compositions and films containing binder, monomer, initiator and chain transfer agent are described in the prior art and sold commercially. One important application of photopolymerizable layers is in graphic arts. A need exists in the graphic arts field to render faithful proofs which describe the image quality that can be attained prior to the printing process. Specifically, it is desirable to demonstrate the appearance and the quality of the printed product prior to its production. The actual mounting of printing plates on a printing press is expensive and time consuming. Adjustments in the printing plate are sometimes necessary in order to achieve the right tonal range, etc. In other cases, it is necessary to remake the plate, if there are any defects in it, such as may be caused by improper exposure of a color separation negative from which a plate is generated.

A number of proofing processes are commercially available. Several of these are capable of giving separate films containing colored images, which on superimposition give a multicolored image that approximates the ultimate pattern generated on the printing press. Other processes depend on selectively toning layers of partially exposed surfaces, to give surprints which more closely resemble the images that are generated on printing than the overlay films described earlier. These processes, however, do not result in the most desirable proof, i.e., one which gives a surprint that is indeed a printed image on unmodified paper stock as is used in printing. Furthermore, the previously cited methods do not permit the facile formation of multiple prints as are frequently required in the printing industry, as for example, when the proof is employed as a press guide in two different locations. The technology described herein addresses the need to make multiple surprints and to overcome the limitations of several commercial proofing processes.

Photopolymerizable layers are currently being used as electrostatic masters for analog color proofing. For this application, a photopolymerizable or photohardenable layer is coated on an electrically conductive substrate and contact exposed with an ultraviolet (UV) source through a half-tone color separation negative. The photopolymerizable composition hardens in the areas exposed with an ultraviolet source due to polymerization and remains in a softer state elsewhere. The differences between the exposed and unexposed areas are apparent in the transport properties, i.e., the unexposed nonpolymerized areas conduct electrostatic charge while the UV exposed areas are substantially non-conductive. By subjecting the exposed photopolymerizable layer to a corona discharge a latent electrostatic image is obtained consisting of electrostatic charge remaining only in nonconducting or exposed areas of the photopolymerizable layer. This charged latent image can be developed by application of a liquid or dry electrostatic developer thereto. When the developer has a charge opposite to that of the corona charge, the developer selectively adheres to the exposed or polymerized areas of the photopolymerizable layer. It is desirable to permit selective toner deposition on the imagewise exposed and charged photopolymerizable layer within a short time after charging. That is, there is the need for a more rapid decay of the unexposed (background) areas of the photopolymerizable or photohardenable layer. As long as a significant amount of charge resides on the unexposed (background) areas, developer will be deposited on these areas, therefore requiring a longer time period between charging and applying developer if background coloring is to be avoided. Although single color electrophotography is a reliable mature technique, color on color electrophotography is relatively new and the application of four different color developer layers on top of each other has its own problems.

While slow charge decay is a problem, we consider the most serious problem in the preparation of color proofs using electrostatic systems to be backtransfer. It was discovered that when a second color developer was transferred from the photohardenable master on top of an existing image on paper, the developer layer originally on the paper partially backtransferred to the electrostatic master during the second transfer. The backtransfer problem worsens when dealing with four layers of developers, since in that case all the previously transferred colors can partially backtransfer from the paper onto the surface of the master. Therefore, the final image on paper is unacceptable due to its degraded color and resolution. In attempting to deal with the backtransfer problem we noted, for example, that the negatively charged toner particles in the liquid electrostatic developer when backtransferred surprisingly were found to be neutral or have positive charges. This charge reversal or neutralization suggested that the large transfer fields partially electrolyzed the toner particles. Charge reversal also implied that toner particles will backtransfer since an electric field that drives negative particles towards the paper would drive positive particles towards the master.

Furthermore, we learned that the toner neutralization occurred on the paper and at the photopolymer electrodes. Backtransfer could be overcome by blocking the toner neutralization either by using dielectric coated paper or by washing the photopolymerizable layer surface with a solution of charge director and carrier liquid with conductivities above a determined threshold value. These approaches, however, are not practical as it is undesirable to use non-standard papers and to wash the surface of the photopolymerizable layer.

Backtransfer has not been observed when the charged surface is a selenium photoconductor and is not a serious problem on silver halide masters. Charged photopolymerizable layers are different with respect to backtransfer. For example, up to 80% of a toned image can be backtransferred to a photopolymerizable master under high ambient humidities and high transfer field conditions. It is therefore believed that the resistivity of the transfer zone and the nature of the charge carrier play important roles in developer backtransfer. In an attempt to overcome the disadvantage of backtransfer, the photopolymerizable composition was formulated to include additives that modified the electrochemistry at the surface of the photopolymerizable layer so that the particular liquid electrostatic developer would transfer from the master onto the paper or subsequent transferred image layer without electrically modifying the toner particles in the developer.

It has now been found that charge decay of the unexposed areas of a photopolymerizable or photohardenable layer and backtransfer of previously developed and transferred images to the surface of the photohardenable layer of an electrostatic master can be greatly improved by introducing into the photohardenable composition used to form the layer an acidic additive of the type described below.

SUMMARY OF THE INVENTION

In accordance with this invention there is provided a high resolution, photohardenable electrostatic master comprising:

(1) an electrically conductive substrate bearing (2) a layer of photohardenable composition consisting essentially of (a) at least one organic polymeric binder, (b) at least one compound having at least one ethylenically unsaturated group, (c) a photoinitiator or photoinitiator system that activates polymerization of the ethylenically unsaturated compound upon exposure to actinic radiation, and (d) an acidic additive selected from the group consisting essentially of:

(1) compounds of the general formula:

$$R—NH—R'$$

where R is $R^1—SO_2$, $$R^1—\overset{\overset{O}{\|}}{C}—,\ R^1—SO_2—NH—\overset{\overset{O}{\|}}{C}—,\ \text{or}\ R^1—\underset{\underset{O}{\|}}{\overset{\overset{R^2}{|}}{P}}—;$$

R′ is H, acyl, alkyl of 1 to 12 carbon atoms, aryl of 6 to 30 carbon atoms, substituted alkyl, substituted aryl, $$R^3—\overset{\overset{O}{\|}}{C}—,$$

halogen or heterocyclic groups;

R and R′ when taken together may form a heterocyclic ring; $R^1$, $R^2$ and $R^3$ may be the same or different and are alkyl of 1 to 12 carbon atoms, aryl of 6 to 30 carbon atoms, substituted alkyl, substituted aryl, acyl, halogen or heterocyclic groups;

(2) phosphonic acids of the general formula:

$$R^4—\overset{\overset{O}{\|}}{P}[OH]_2$$

where $R^4$ is alkyl of 1 to 12 carbon atoms, aryl of 6 to 30 carbon atoms, substituted alkyl, substituted aryl, halogen or heterocyclic groups; and (3) polybasic carboxylic acids having at least two acid groups.

In accordance with an embodiment of this invention there is provided a xeroprinting process comprising (A) exposing imagewise to actinic radiation a photohardenable electrostatic master comprising (1) an electrically conductive substrate bearing (2) a layer of photohardenable composition consisting essentially of (a) at least one organic polymeric binder, (b) at least one compound having at least one ethylenically unsaturated group, and (c) a photoinitiator or photoinitiator system that activates polymerization of the ethylenically unsaturated compound upon exposure to actinic radiation, and (d) an acidic additive selected from the group consisting essentially of:

(1) compounds of the general formula:

$$R—NH—R'$$

where R is $R^1—SO_2$, $$R^1—\overset{\overset{O}{\|}}{C}—,\ R^1—SO_2—NH—\overset{\overset{O}{\|}}{C}—,\ \text{or}\ R^1—\underset{\underset{O}{\|}}{\overset{\overset{R^2}{|}}{P}}—$$

R′ is H, acyl, alkyl of 1 to 12 carbon atoms, aryl of 6 to 30 carbon atoms, substituted alkyl, substituted aryl, $$R^3—\overset{\overset{O}{\|}}{C}—,$$

halogen or heterocyclic groups;

R and R′ when taken together may form a heterocyclic ring; $R^1$, $R^2$ and $R^3$ may be the same or different and are alkyl of 1 to 12 carbon atoms, aryl of 6 to 30 carbon atoms, substituted alkyl, substituted aryl, acyl, halogen or heterocyclic groups;

(2) phosphonic acids of the general formula:

$$R^4—\overset{\overset{O}{\|}}{P}[OH]_2$$

where $R^4$ is alkyl of 1 to 12 carbon atoms, aryl of 6 to 30 carbon atoms, substituted alkyl, substituted aryl, halogen or heterocyclic groups; and (3) polybasic carboxylic acids having at least two acid groups.

(B) charging the photohardenable master electrostatically, (C) applying an oppositely charged electrostatic toner, and (D) transferring the toned image to a receptor surface.

DETAILED DESCRIPTION OF THE INVENTION

Throughout the specification the below-listed terms have the following meanings:

In the claims appended hereto "consisting essentially of" means the composition of the photohardenable layer does not exclude unspecified components which do not prevent the advantages of the layer from being realized. For example, in addition to the primary components, there can be present additional components, such as sensitizers, including visible sensitizers, hydrogen donors or chain transfer agents (preferred), both of which are considered part of the photoinitiator system; thermal stabilizers or thermal polymerization inhibitors, photoinhibitors, antihalation agents, UV absorbers, release agents, colorants, surfactants, plasticizers, electron donors, electron acceptors, etc.

Photohardenable and photopolymerizable are used interchangeably in this invention.

Monomer means simple monomers, as well as polymers, usually of molecular weights below 1500, having at least one, preferably two or more, ethylenic groups capable of crosslinking or addition polymerization.

The photohardenable (photopolymerizable) layer of the electrostatic master consists essentially of at least one organic polymeric binder, a compound having at least one ethylenically unsaturated group which can be a monomer, a photoinitiator or photoinitiator system, and an acidic additive as more fully described below. Preferably a chain transfer agent is also present. In addition to the primary ingredients, other ingredients which do not prevent the advantages of the invention from being achieved. These other ingredients which can also be present are set out below. Useful polymeric binders, ethylenically unsaturated compounds, photoinitiators, including preferred hexaarylbiimidazole compounds (HABI's) and chain transfer agents are disclosed in Chambers U.S. Pat. No. 3,479,185, Baum et al. U.S. Pat. No. 3,652,275, Cescon U.S. Pat. No. 3,784,557, Dueber U.S. Pat. No. 4,162,162, and Dessauer U.S. Pat. No. 4,252,887, the disclosures of each of which are incorporated herein by reference.

The primary components include:

BINDERS

Suitable binders include: acrylate and methacrylate polymers and co- or terpolymers; vinyl polymers and copolymers, polyvinyl acetals, such as polyvinyl butyral and polyvinyl formal; vinylidene chloride copolymers (e.g., vinylidene chloride/acrylonitrile, vinylidene chloride/methacrylate and vinylidene chloride/vinyl acetate copolymers), polyesters, polycarbonates, polyurethanes, polysulfones, polyetherimides and polyphenylene oxides, synthetic rubbers such as butadiene copolymers, e.g., butadiene/acrylonitrile copolymers and chloro-2-butadiene-1,3-polymers; cellulose esters, e.g., cellulose acetate, cellulose acetate succinate and cellulose acetate butyrate; cellulose ethers, polyvinyl esters, e.g., polyvinyl acetate/acrylate, polyvinyl acetate/methacrylate and polyvinyl acetate; polyvinyl chloride and copolymers, e.g., polyvinyl chloride/acetate; polystyrene, etc. Preferred binders are poly(styrene/methyl methacrylate) and polymethyl methacrylate. Blends of high and low Tg binders have been found to improve environmental latitude of the photopolymerizable layers. In general, it has been found that a high Tg binder (approximately in the range of 80°–110° C.) and a low Tg binder (approximately in the range of 50°–70° C.) are preferred. Types of high Tg resins useful as a binder include: certain acrylate and methacrylate polymers and copolymers, certain vinyl polymers and copolymers, certain polyvinyl acetals, polycarbonates, polysulfones, polyetherimides, polyphenylene oxides, etc. Types of low Tg resins useful as a binder include: certain acrylate and methacrylate polymers and copolymers, certain vinyl polymers and copolymers, certain polyvinyl acetals, polyesters, polyurethanes, butadiene copolymers, cellulose esters, cellulose ethers, etc. Preferred low Tg resins include poly(ethyl methacrylate) (Tg 70° C.), Elvacite ® 2042 and 2045 resins. Preferred high Tg resins include poly(methyl methacrylate) (Tg 110° C.) and poly(styrene/methyl methacrylate).

A useful resistivity range of the binder or binder combinations is about $10^{14}$ to $10^{20}$ ohm-cm, preferably $10^{14}$ to $10^{16}$ ohm-cm range.

COMPOUNDS HAVING ETHYLENIC UNSATURATION

Any ethylenically unsaturated photopolymerizable or photocrosslinkable compound can be used in the practice of this invention. Preferred compounds are monomers which have at least two terminal ethylenically unsaturated groups, e.g., di-, tri-, and tetraacrylates and methacrylates such as ethylene glycol diacrylate, diethylene glycol diacrylate, triethylene glycol diacrylate, glycerol diacrylate, glycerol triacrylate, glycerol propoxylated triacrylate, ethylene glycol dimethacrylate, 1,2-propanediol dimethacrylate, 1,2,4-butanetriol trimethacrylate, 1,4-cyclohexanediol diacrylate, 1,4-benzenediol dimethacrylate, pentaerythritol triacrylate, pentaerythritol trimethacrylate, pentaerythritol tetramethacrylate, 1,3-propanediol diacrylate, 1,5-pentanediol dimethacrylate, trimethylolpropane triacrylate, ethoxylated trimethylolpropane triacrylate, the bisacrylates and bismethacrylate of polyethylene glycols of molecular weight 100–500, tris-(2-hydroxyethyl)isocyanurate triacrylate, etc. Especially preferred monomers are glyceryl propoxylated triacrylate, trimethylolpropane triacrylate and mixtures thereof.

A monomer with a resistivity in the range of about $10^5$ to $10^9$ ohm-cm is particularly useful. Mixtures of monomers have been found to enhance the improvement in environmental stability of the photohardenable or photopolymerizable master. In this respect, blends of glycerol propoxylated triacrylate and trimethylolpropane triacrylate in a 2:1 ratio were found to give the best overall performance.

INITIATORS AND/OR INITIATOR SYSTEMS

A large number of free-radical generating compounds can be utilized in the photopolymerizable compositions. Preferred initiator systems are 2,4,5-triphenylimidazolyl dimers with hydrogen donors, also known as the 2,2',4,4',5,5'-hexaarylbiimidazoles, or HABI's, and mixtures thereof, which dissociate on exposure to actinic radiation to form the corresponding triarylimidazolyl free radicals. HABI's and use of HABI-initiated photopolymerizable systems for applications other than for electrostatic uses have been previously disclosed in a number of patents. These include: Chambers, U.S. Pat. No. 3,479,185, Chang et al., U.S. Pat. No. 3,549,367, Baum and Henry, U.S. Pat. No. 3,652,275, Cescon, U.S. Pat. No. 3,784,557, Dueber, U.S. Pat. No. 4,162,162, Dessauer, U.S. Pat. No. 4,252,887, Chambers et al., U.S. Pat. No. 4,264,708, Wade et al. U.S. Pat. No. 4,410,621, and Tanaka et al., U.S. Pat. No. 4,459,349, the disclosures of which are incorporated herein by reference. Useful 2,4,5-triarylimidazolyl dimers are disclosed in Baum and Henry, U.S. Pat. No. 3,652,275 column 5, line 44 to column 7, line 16, the disclosure of which is incorporated herein by reference. Any 2-o-substituted HABI disclosed in the prior patents can be used in this invention.

The HABI's can be represented by the general formula

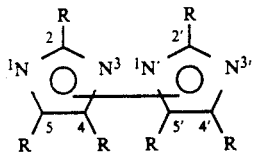

where the R's represent aryl, e.g., phenyl, naphthyl, radicals. The 2-o-substituted HABI's are those in which the aryl radicals at the 2- and 2'-positions are orthosubstituted or with polycyclic condensed aryl radicals. The other positions on the aryl radicals can be unsubstituted or carry any substituent which does not interfere with the dissociation of the HABI upon exposure or adversely affect the electrical or other characteristics of the photopolymer system.

Preferred HABI's are 2-o-chlorosubstituted hexaphenylbiimidazoles in which the other positions on the phenyl radicals are unsubstituted or substituted with chloro, methyl or methoxy. The most preferred initiators include: 2-(o-chlorophenyl)-4,5-bis(m-methoxyphenyl)imidazole dimer, 1,1'-biimidazole, 2,2-bis(o-chlorophenyl)-4,4,'5,5'-tetraphenyl biimidazole, 2,5-bis-(o-chlorophenyl)-4,-[3,4-dimethoxyphenyl]-imidazole dimer, and 2,2',4,4'-tetrakis(o-chlorophenyl)-5,5'-bis(m,p-dimethoxyphenyl)biimidazole, each of which is typically used with a hydrogen donor or chain transfer agent described below.

Photoinitiators that are also useful in the photohardenable composition in place of the HABI type photoinitiators include: the substituted or unsubstituted polynuclear quinones, aromatic ketones, and benzoin ethers. Examples of such other photoinitiators are quinones, for example, 9,10-anthraquinone, 1-chloroanthraquinone, 2-chloroanthraquinone, 2-methylanthraquinone, 2-ethylanthraquinone, 2-tert-butylanthraquinone, octamethylanthraquinone, 1,4-naphthoquinone, 9,10-phenanthrenequinone, 1,2-benzanthraquinone, 2,3-benzanthraquinone, 2-methyl-1,4-naphthoquinone, 2,3-dichloronaphthoquinone, 1,4-dimethylanthraquinone,2,3-dimethylanthraquinone, 2-phenylanthraquinone, 2,3-diphenylanthraquinone, sodium salt of anthraquinone α-sulfonic acid, 3-chloro-2-methylanthraquinone, retenequinone, 7,8,9,10-tetrahydronaphthacenequinone, 1,2,3,4-tetrahydrobenz(a) anthracene-7,12-dione; aromatic ketones, for example, benzophenone, Michler's ketone, 4,4'-bis(dimethylamino)benzophenone; 4,4'-bis(diethylamino)benzophenone, 4-acryloxy-4'-diethylaminobenzophenone, 4-methoxy-4'-dimethylaminobenzophenone, xanthones, thioxanthones; and benzoin ethers, for example, benzoin methyl and ethyl ethers. Still other photoinitiators which are also useful, are described in Plambeck U.S. Pat. No. 2,760,863 and include vicinal ketaldonyl alcohols, such as benzoin, pivaloin, acyloin ethers, α-hydrocarbonsubstituted aromatic acyloins, including α-methylbenzoin, α-allylbenzoin and α-phenylbenzoin. Additional systems include α-diketones with amines as disclosed in Chang, U.S. Pat. No. 3,756,827, and benzophenone with p-dimethylaminobenzaldehyde or with esters of p-dimethylaminobenzoic acid as disclosed in Barzynski et al., U.S. Pat. No. 4,113,593. The disclosures of the above patents are incorporated herein by reference.

Redox systems, especially those involving dyes, e.g., Rose Bengal, 2-dibutylaminoethanol, are also useful in the practice of this invention. Photoreducible dyes and reducing agents such as those disclosed in U.S. Pat. Nos. 2,850,445; 2,875,047; 3,074,974; 3,097,096; 3,097,097; 3,145,104; and 3,579,339; as well as dyes of the phenazine, oxazine, and quinone classes can be used to initiate photopolymerization, the disclosures of which are incorporated herein by reference. A useful discussion of dye sensitized photopolymerization can be found in "Dye Sensitized Photopolymerization" by D. F. Eaton in Adv. in Photochemistry, Vol. 13, D. H. Volman, G. S. Hammond, and K. Gollinick, eds., Wiley-Interscience, New York, 1986, pp. 427–487.

ACIDIC ADDITIVE

The acidic additive is selected from the group consisting essentially of:

(1) compounds of the general formula:

$$R—NH—R'$$

where R is $R^1—SO_2$, $$R^1—\overset{O}{\overset{\|}{C}}—,\ R^1—SO_2—NH—\overset{O}{\overset{\|}{C}}—,\ \text{or}\ R^1—\overset{R^2}{\overset{|}{\underset{\underset{O}{\|}}{P}}}—$$

R' is H, acyl, alkyl of 1 to 12 carbon atoms, aryl of 6 to 30 carbon atoms, substituted alkyl, substituted aryl, $$R^3—\overset{O}{\overset{\|}{C}}—,$$

halogen or heterocyclic groups;

R and R' when taken together may form a heterocyclic ring; $R^1$, $R^2$ and $R^3$ may be the same or different and are alkyl of 1 to 12 carbon atoms, aryl of 6 to 30 carbon atoms, substituted alkyl, substituted aryl, acyl, halogen or heterocyclic groups.

(2) phosphonic acids of the general formula:

$$R^4—\overset{O}{\overset{\|}{P}}[OH]_2$$

where $R^4$ is alkyl of 1 to 12 carbon atoms, aryl of 6 to 30 carbon atoms, substituted alkyl, substituted aryl, halogen or heterocyclic groups; and (3) polybasic carboxylic acids having at least two acid groups.

Compounds of Group 1 include: sulfonamides and imides, sulfonylureas, carboximides, and phosphonamides.

Sulfonamides and imides are represented by the formula:

$$R^1—SO_2—NH—R'$$

where $R^1$ is alkyl of 1 to 12 carbon atoms, aryl of 6 to 30 carbon atoms, substituted alkyl or substituted aryl substituted with alkyl, e.g., 1 to 10 carbon atoms, alkoxy of 1 to 6 carbon atoms, halogen, e.g., Cl, Br, I; amino, carboxylic ester, etc.; and R' is H, acyl, alkyl of 1 to 12 carbon atoms, aryl of 6 to 30 carbon atoms, substituted alkyl or substituted aryl substituted as described above for $R^1$. Sulfonamides are illustrated in the examples by A3, A4, A5, A6, and A7. Sulfonamides and imides are described in the following publications:

"Sulfonamides and Allied Compounds" by E. H. Northey, 1948, Reinhold Publishing Corp., N.Y.

"Sulfonamides" Encyclopedia of Chemical Technology, Volume 2, Kirk-Othmer, pp. 795–808, 1978, Wiley-Interscience, N.Y.

Sulfonylureas are represented by the formula:

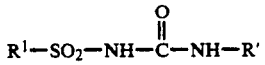

where $R^1$ and $R'$ may be the same or different and are alkyl of 1 to 12 carbon atoms, aryl of 6 to 30 carbon atoms, substituted alkyl or substituted aryl substituted with alkyl, e.g., 1 to 10 carbon atoms, alkoxy of 1 to 6 carbon atoms, halogen, e.g., Cl, Br, I; amino, carboxylic ester, etc.; and heterocyclic 5- or 6-membered rings containing N, 0, S, Se, P, As, etc., in the ring. Suitable sulfonylureas and their method of preparation are described in U.S. Pat. Nos. 4,127,405, 4,383,113, 4,394,506, 4,420,325, 4,435,206, 4,478,635, 4,479,821, 4,481,029, 4,514,212, 4,789,393, 4,810,282, and EP-A-87,780. Sulfonylurea is illustrated in the examples by A11.

Carboximides are represented by the formula:

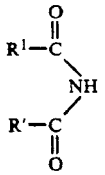

where $R^1$ and $R'$ may be the same or different and are alkyl of 1 to 12 carbon atoms, aryl of 6 to 30 carbon atoms, substituted alkyl or substituted aryl substituted with alkyl, e.g., 1 to 10 carbon atoms, alkoxy of 1 to 6 carbon atoms, halogen, e.g., Cl, Br, I; amino, carboxylic ester, etc.; and heterocyclic 5- or 6-membered rings) containing N, 0, S, Se, P, As, etc., in the ring. $R^1$ and $R'$ when taken together may form heterocyclic 5- or 6-membered rings or condensed rings. Carboximides are illustrated in the examples by A9 (acyclic), A8 and A10 (cyclic). Other useful carboximide compounds include:

Barbituric acid

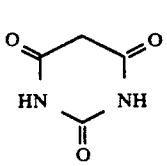

Uric acid

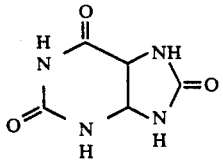

Alloxan

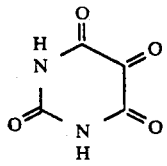

Thymine

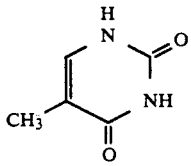

-continued

Uracil

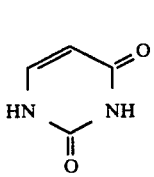

Pyromellitic diimide

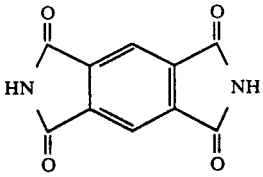

Phosphonamides are represented by the formula:

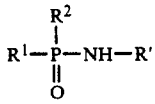

where $R^1$, $R'$ and $R^2$ may be the same or different and are alkyl of 1 to 12 carbon atoms, aryl of 6 to 30 carbon atoms, substituted alkyl or substituted aryl substituted with alkyl, e.g., 1 to 10 carbon atoms, alkoxy of 1 to 6 carbon atoms, halogen, e.g., Cl, Br, I; amino, carboxylic ester, etc.; halogen, or heterocyclic 5- or 6-membered) containing N, O, S, Se, P, As, etc., in the ring. Phosphonamide is illustrated in the examples by A13. Additional phosphonamide compounds are derived from phosphonic acids described in the following paragraph.

Phosphonic acid is represented by the formula:

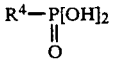

where $R^4$ is alkyl of 1 to 12 carbon atoms, aryl of 6 to 30 carbon atoms, substituted alkyl or substituted aryl substituted with alkyl, e.g., 1 to 10 carbon atoms, alkoxy of 1 to 6 carbon atoms, halogen, e.g., Cl, Br, I; amino, carboxylic ester, etc.; halogen, and heterocyclic 5- or 6-membered rings containing N, 0, S, Se, P, As, etc. in the ring. Phosphonic acid is illustrated in the examples by A12. Additional phosphonic acids are described in the following publications:

"Organophosphorus Compounds" by G. M. Kosolapoff, pp. 148–170, 1950, John Wiley and Sons, Inc., N.Y.

"Organophosphorus Chemistry", Specialist Periodical Reports, Volumes 1 to 19,1970 to 1988, The Chemical Society, Burlington House, London.

Polybasic carboxylic acids having at least 2 acid groups, which are more acidic than monobasic acids, are represented by the formula:

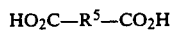

wherein $R^5$ is aliphatic of 0 to 12 carbon atoms (saturated or unsaturated substituted or unsubstituted), aryl of 6 to 30 carbon atoms, substituted alkyl and substituted aryl substituted with alkyl, e.g., 1 to 10 carbon atoms, alkoxy of 1 to 6 carbon atoms, halogen, e.g., Cl, Br, I;amino, carboxylic ester, etc. Suitable polybasic acids include oxalic, malonic, citric, tartaric, maleic, fumaric, trimellitic, phthalic, diphenic, pyromellitic, naphthalene dicarboxylic, etc. Polybasic acids are illustrated in the examples by A14, A15, A16 and A17. Additional polybasic carboxylic acids are described in the following references:

"Practical Organic Chemistry" by A. I. Vogel, pp. 489–495 and 751–779, 1957, John Wiley & Sons, N.Y.

"Chemistry of Organic Compounds" by C. R. Noller, pp. 870–891, 1965, W. B. Saunders Company, Philadelphia.

ADDITIONAL COMPONENTS

Sensitizers

Sensitizers useful with these photoinitiators include those disclosed in U.S. Pat. Nos. 3,554,753; 3,563,750; 3,563,751; 3,647,467; 3,652,275; 4,162,162; 4,268,667; 4,351,893; 4,454,218; 4,535,052; and 4,565,769, the disclosures of which are incorporated hereby by reference.

A preferred group of visible sensitizers include the bis(p-dialkylaminobenzylidene) ketones disclosed in Baum and Henry, U.S. Pat. No. 3,652,275 and the arylyidene aryl ketones disclosed in Dueber, U.S. Pat. No. 4,162,162, as well as in U.S. Pat. Nos. 4,268,667 and 4,351,893, the disclosure of each being incorporated herein by reference. These compounds extend the sensitivity of the initiator system to visible wavelengths where lasers emit. Particularly preferred sensitizers are: 2-{9'(2',3',6',7'-tetrahydro-1H,5H-benzo[i,j]-quinolylidene)}-5,6-dimethoxy-1-indanone (DMJDI), and 2,5Bis{9'-(2',3',6',7'-tetrahydro-lH,5H-benzo[i,j-]quinolylidene)}cyclopentanone (JAW).

CHAIN TRANSFER AGENTS

Any chain transfer agent, or hydrogen donor, identified in the prior patents for use with HABI-initiated photopolymerizable systems can be used. For example, Baum and Henry, U.S. Pat. No. 3,652,275 discloses N-phenylglycine, 1,1-dimethyl-3,5-diketocyclohexane, and organic thiols such as 2-mercaptobenzothiazole, 2-mercaptobenzoxazole, 2-mercaptobenzimidazole, pentaerythritol tetrakis(mercaptoacetate), 4-acetamidothiophenol, mercaptosuccinic acid, dodecanethiol, and beta-mercaptoethanol, 2-mercaptoethane sulfonic acid, 1-phenyl-4H-tetrazole-5-thiol, 6-mercaptopurine monohydrate, bis-(5-mercapto-1,3,4-thiodiazol-2-yl, 2-mercapto-5-nitrobenzimidazole, and 2-mercapto-4-sulfo-6-chlorobenzoxazole, the disclosure of which is incorporated by reference. Also useful are various tertiary amines known in the art. Other hydrogen donor compounds useful as chain transfer agents in photopolymerizable compositions include various other types of compounds, e.g., (a) ethers, (b) esters, (c) alcohols, (d) compounds containing allylic or benzylic hydrogen cumene, (e) acetals, and (f) aldehydes, as disclosed in column 12, lines 18 to 48, of MacLachlan, U.S. Pat. No. 3,390,996, the disclosure of which is incorporated herein by reference. The preferred chain transfer agents are 2-mercaptobenzoxazole (2-MBO) and 2-mercaptobenzothiazole (2-MBT).

OTHER ADDITIONAL COMPONENTS

The photohardenable compositions may also contain other ingredients which are conventional components used in photopolymerizable systems. Such components include: thermal stabilizers or thermal polymerization inhibitors, photoinhibitors, antihalation agents, UV absorbers, release agents, colorants, surfactants, plasticizers, electron donors, electron acceptors, charge carriers, etc.

Normally a thermal stabilizer or thermal polymerization inhibitor will be present in small quantities, e.g., $<0.1\%$, to increase stability in the storage of the photopolymerizable composition. Useful thermal stabilizers or inhibitors include: hydroquinone, phenidone, p-methoxyphenol, alkyl and aryl-substituted hydroquinones and quinones, tert-butyl catechol, pyrogallol, copper resinate, naphthylamines, beta-naphthol, cuprous chloride, 2,6-di-tert-butyl p-cresol, phenothiazine, pyridine, nitrobenzene, dinitrobenzene, p-toluquinone and chloranil. The dinitroso dimers described in Pazos, U.S. Pat. No. 4,168,982 are also useful, the disclosure of which is incorporated. A preferred stabilizer is TAOBN, i.e., 1,4,4-trimethyl-2,3-diazobicyclo-(3.2.2)-non-2-ene-N,N-dioxide.

Photoinhibitors are disclosed in Pazos U.S. Pat. No. 4,198,242, the disclosure of which is incorporated herein by reference. A specific photoinhibitor is 1-(2'-nitro-4',5'-dimethoxy)phenyl-1-(4-t-butylphenoxy)ethane.

Antihalation agents useful in the photohardenable compositions include known antihalation dyes.

Ultraviolet radiation absorbing materials useful in the invention are also disclosed in U.S. Pat. No. 3,854,950, the disclosure of which is incorporated herein by reference.

Compounds present in the composition as release agents are described in Bauer, U.S. Pat. No. 4,326,010, the disclosure of which is incorporated herein by reference. A specific release agent is polycaprolactone.

Suitable plasticizers include: triethylene glycol, triethylene glycol dipropionate, triethylene glycol dicaprylate, triethylene glycol bis(2-ethyl hexanoate), tetraethylene glycol diheptanoate, polyethylene glycol, diethyl adipate, tributyl phosphate, etc. Other plasticizers that yield equivalent results will be apparent to those skilled in the art.

Suitable electron donors and acceptors are disclosed in Blanchet-Fincher et al., U.S. Pat. No. 4,849,314, the disclosure of which is incorporated herein by reference.

Suitable charge carriers are disclosed in Blanchet-Fincher et al. U.S. Pat. No. 4,818,660, the disclosure of which is incorporated herein by reference.

Suitable leuco dyes include: tris-(o-methyl-p-diethylaminophenyl)methane, 4,4'-benzylidene bis (N,N-dimethylaniline) as disclosed in Blanchet-Fincher et al. U.S. Pat. No. 4,818,660, column 8, lines 26-34, the disclosure of which is incorporated herein by reference.

PROPORTIONS

In general, the components should be used in the following approximate proportions: binder 40–70%, preferably 50–65%; monomer 15–40%, preferably 20–35%, initiator 1–20%, preferably 1–8%, acidic additive 1–10%, preferably 2–6%, and chain transfer agent or hydrogen donor 0–10%, preferably 0.1–4%. These are weight percentages based on total weight of the photopolymerizable system.

The preferred proportions depend upon the particular compounds selected for each component and the application for which the photohardenable composition is intended. For example, a high conductivity monomer can be used in smaller amount than a low conductivity monomer, since the former will be more efficient in eliminating charge from unexposed areas.

The amount of HABI photoinitiator will depend upon film speed requirement. Photohardenable compositions with HABI content above 10% provide films of high sensitivity (high speed) and can be used with laser imaging in recording digitized information, as in digital color proofing. Such films are the subject of Legere U.S. Ser. No. 07/284,891, filed Dec. 13, 1988, now U.S. Pat. No. 4,911,999, the disclosure of which is incorporated herein by reference. For analog applications, e.g., exposure through a negative, film speed requirement depends upon mode of exposure. Slow speed films are acceptable for analog applications.

COATING/SUBSTRATES

The photohardenable layer is prepared by mixing the ingredients of the photopolymerizable composition in a solvent, such as methylene chloride, usually in the weight ratio of about 15:85 to 25:75 (solids to solvent), coating on a substrate, and evaporating the solvent. Coatings should be uniform and should have a thickness of 3 to 20 μm, preferably 7 to 12 μm, when dry. Dry coating weight should be about 30 to 200 mg/dm$^2$, preferably 80 to 150 mg/dm$^2$. A coversheet, e.g., polyethylene, polypropylene, polyethylene terephthalate, etc. is preferably placed over the photohardenable layer after the solvent evaporates for protection.

The substrate should be uniform and free of defects such as pinholes, bumps, and scratches. It can be a support, such as paper, glass, synthetic resin and the like, which has been coated by vapor deposition or sputtering chemical deposition on one or both sides with a metal, conductive metal oxide, or metal halide, such as aluminized polyethylene terephthalate; or a conductive paper or polymeric film. The coated substrate mounted directly on a conductive support can be mounted directly on the printing device.

Alternatively, the substrate can be a non-conducting film, preferably a release film such as polyethylene or polypropylene. After removal of the protective cover sheet, the photohardenable layer can then be laminated to a conductive support on the printing device with the tacky, photohardenable layer adjacent to the support. The substrate then acts as a coversheet which is removed after exposure but prior to charging.

As another alternative, the conductive support may be a metal plate, such as aluminum, copper, zinc, silver or the like; or a support which has been coated with a polymeric binder containing a metal, conductive metal oxide, metal halide, conductive polymer, carbon black or other conductive filler.

ELECTRICAL CHARACTERISTICS

To evaluate the photopolymerizable compositions, voltage is measured on the unexposed photohardenable layer as a function of time using standard conditions of charging and measurement.

The desired electrical properties of the photohardenable element are dependent on the charge deposited on the photohardenable surface and the electrical characteristics of the particular toner or developer system employed. Ideally, at the time of contact, e.g., with a developer dispersion, the voltage in the exposed areas (Vexp) should be at least 10 V, preferably at least 100 V and even up to 400 V or higher, more than that of the voltage in unexposed areas (Vunexp). Resistivity of the exposed areas should be between about $10^{14}$ and $10^{17}$ ohm-cm. Resistivity in the unexposed areas should be between $10^{12}$ and $10^{15}$ ohm-cm and the ratio of resistivity in exposed areas to resistivity in unexposed areas should be at least 100. A typical time for toner or developer application is between 1 and 5 seconds after charging.

EXPOSURE/CHARGING/TONING/TRANSFER

To provide the required conductivity differential, exposure must be sufficient to cause substantial polymerization in exposed areas. Exposing radiation can be modulated by either digital or analog means. Analog exposure utilizes a line or halftone negative or other pattern interposed between the radiation source and photohardenable layer of the master. For analog exposure an ultraviolet light source is preferred, since the photopolymerizable system is more sensitive to shorter wavelength radiation. Digital exposure may be carried out by a computer controlled, light-emitting, e.g., visible light emitting, laser which scans the film in raster fashion. For digital exposure a high speed film, i.e., one which contains a high level of HABI and which has been sensitized to longer wavelengths with a sensitizing dye, is preferred. Electron beam exposure can be used, but is not preferred because of the expensive equipment required.

The preferred electrostatic charging means is corona discharge. Other charging methods include: discharge of a capacitor, negative corona discharge, shielded corotron, scorotron, etc.

Any electrostatic toner or developer and any method of developer application can be used. Liquid developers, i.e., a suspension of pigmented resin toner particles in a nonpolar dispersant liquid present in major amount, are preferred. The liquids normally used are Isopar® branched-chain aliphatic hydrocarbons (sold by Exxon Corporation) which have a Kauri-butanol value of less than 30. These are narrow high-purity cuts of isoparaffinic hydrocarbon fractions with the following boiling ranges Isopar®-G, 157°-176° C., Isopar®-H 176°-191° C., Isopar®-K 177°-197° C., Isopar®-L 188°-206° C., Isopar®-M 207°-254° C., Isopar®-V 254°-329° C. The liquid developers may contain various adjuvants which are described in: Mitchell, U.S. Pat. Nos. 4,631,244, 4,663,264, and 4,734,352; Taggi, U.S. Pat. No. 4,670,370; Larson and Trout, U.S. Pat. No. 4,681,831; El-Sayed and Taggi, U.S. Pat. No. 4,702,984; Larson, U.S. Pat. No. 4,702,985; and Trout, U.S. Pat. No. 4,707,429. The liquid electrostatic developers can be prepared as described in Larson U.S. Pat. No. 4,760,009. The disclosures in these patents are incorporated herein by reference.

Also present in the liquid electrostatic developers are thermoplastic resins, having an average particle size of less than 10 μm, e.g., as determined by the Horiba CAPA-500 centrifugal particle analyzer, Horiba Instruments, Inc., Irvine, Calif., and Malvern 3600E Particle Sizer, Malvern, Southborough, Mass., which are, for example, copolymers of ethylene (80 to 99.9%) with acrylic acid, methacrylic acid, or alkyl esters, where alkyl is 1 to 5 carbon atoms, of acrylic or methacrylic acid (20 to 0.1%), e.g., an ethylene/methacrylic acid (89:11) copolymer having a melt index at 190° C. of 100. Preferred nonpolar liquid soluble ionic or zwitterionic components present in such developers, for example, are lecithin and Basic Barium Petronate® oil-soluble petroleum sulfonate, Witco Chemical Corp., New York, N.Y.

Many of the monomers useful in the photohardenable composition described above are soluble in these Isopar® hydrocarbons, especially in Isopar®-L. Consequently, repeated toning with Isopar®-based developers to make multiple copies can deteriorate the electrical properties of the photohardenable master by extraction of monomer from unexposed areas. The preferred monomers are relatively insoluble in Isopar® hydrocarbons, and extended contact with these liquids does not unduly deteriorate photohardenable layers made with these monomers. Photohardenable electrostatic masters made with other, more soluble monomers can still be used to make multiple copies, using liquid developer having a dispersant with less solvent action.

Representative dry electrostatic toners that may be used include: Kodak Ektaprint K, Hitachi HI-Toner HMT-414, Canon NP-350F toner, Toshiba T-50P toner, etc. The invention is not limited by these toners.

After developing the toned image is transferred to a receptor surface, such as paper, for the preparation of a proof. Other receptors include: polymeric film, cloth, etc. For making integrated circuit boards, the transfer surface can be an insulating board on which conductive circuit lines can be printed by the transfer, or the surface can be an insulating board covered with a conductor, e.g., a fiber glass board covered with a copper layer, on which a resist is printed by transfer.

Transfer is accomplished by electrostatic or other means, e.g., by contact with an adhesive receptor surface. Electrostatic transfer can be accomplished in any known manner, e.g., by placing the receptor surface, e.g., paper, in contact with the toned image. A tackdown roll or corona, when held at negative voltages, will press the two surfaces together assuring intimate contact. After tackdown, a positive corona discharge is applied to the backside of the paper to drive the toner particles off the electrostatic master onto the paper.

INDUSTRIAL APPLICABILITY

The photohardenable electrostatic master having improved charge decay characteristics is particularly useful in the graphic arts field, especially in the area of color proofing wherein the proofs prepared duplicate the images produced by printing. This is accomplished by controlling the gain of the reproduced halftone dots through control of the electrical conductivity of the exposed and unexposed areas of the photohardenable electrostatic master. Since the voltage retained by the halftone dots is almost linearly related to the percent dot area, the thickness of the liquid electrostatic developer will be constant everywhere on the image, independent of the particular dot pattern to be developed. The photohardenable electrostatic master has improved adhesion of the photohardenable layer to the substrate over previous photohardenable electrostatic masters. Other uses for the photohardenable master include preparation of printed circuit boards, resists, soldermask, photohardenable coatings, etc.

EXAMPLES

The advantageous properties of this invention can be observed by reference to the following examples which illustrate, but do not limit, the invention. The parts and percentages are by weight.

Glossary

BINDERS

B1 Poly(styrene/methyl methacrylate) 70/30 copolymer
B2 Poly (methyl methacrylate)
B3 Poly (ethyl methacrylate)

MONOMERS

M1 Ethoxylated trimethylolpropane triacrylate
M2 Glycerol propoxylated triacrylate
M3 Trimethylolpropane triacrylate

INITIATORS

IN 1 2,2',4,4'-tetrakis(o-chlorophenyl)-5,5'-bis(m,p-dimethoxyphenyl) biimidazole (TCTM-HABI)
IN 2 Benzoin methyl ether
IN 3 2-Chloro-thioxanthenone

CHAIN TRANSFER AGENT

CT1 2-Mercaptobenzoxazole (2-MBO)
CT2 2-Mercaptobenzothiazole (2-MBT)

STABILIZER OR INHIBITOR

S1 1,4,4-Trimethyl-2,3-diazobicyclo-[3,2,2]-non-2-ene-N,N-dioxide
S2 1-(2'-Nitro-4',5'-dimethoxyphenyl)-1-(4-t-butylphenoxy)ethane (α-methyl-BPE)

LEUCO DYES

LD1 Tris-(o-methyl-p-diethylaminophenyl) methane
LD2 Leuco Malachite Green, 4,4'-benzylidenebis(N,N-dimethylaniline)

ACIDIC ADDTTIVES

A1 Acetic acid (Control)
A2 p-Toluic acid (Control)
A3 Benzenesulfonamide
A4 Ketjenflex®9 S, mixture of o, p-toluenesulfonamide
A5 Alpha-toluenesulfonamide
A6 p-(p-Toluenesulfonamido) diphenylamine
A7 Saccharin or benzoic sulfonimide
A8 Phthalimide
A9 Diacetamide
A10 Parabanic acid
A11 N-(2-methoxy-4-methyl-S-triazinyl)-N'-(o-chlorobenzenesulfonyl) urea
A12 Benzene phosphonic acid
A13 Phenyl N-phenylphosphonamido chloridate
A14 Phthalic acid
A15 Maleic acid
A16 Diphenic acid
A17 Citric acid Except as indicated otherwise, the following procedures were used in all examples.

A solution containing about 80 parts methylene chloride and 20 parts of solids was coated onto a 0.004 inch (0.0102 cm) aluminized polyethylene terephthalate support. After the film had been dried at 60°-95° C. to remove the methylene chloride, a 0.00075 inch (0.0019 cm) polypropylene cover sheet was laminated to the dried layer. The coating weights varied from 80 to 150 mg/dm$^2$. The film was then wound on rolls until exposure and development occurred.

In order to test the image quality of each photopolymerizable composition, the photopolymerizable layer was exposed, charged, and toned with magenta toner, and the image transferred to paper as described below. In all cases "magenta toner" refers to the standard magenta toner used to form a four color proof described below. The evaluation of image quality was based on dot range and dot gain on paper. The standard paper is 60 lbs Solitaire® paper, offset enamel text, Plainwell Paper Co., Plainwell, Mich. However, the variety of papers tested included: 60 lbs Plainwell offset enamel text, 70 lbs Plainwell offset enamel text, 150 lbs white regal Tufwite® Wet Strength Tag, 60 lbs White LOE Gloss Cover, 70 lbs white Flokote® Text, 60 lbs white all purpose lith, 110 lbs white Scott index, 70 lbs white Nekoosa Vellum Offset and 80 lbs white Sov® text. Results indicated that, although the process can be used with any paper, the trapping of ink varies with the fibrillar nature of the paper in use.

Dot gain or dot growth versus dot size is a standard measure of how tolerances between a proof and a press proof are determined. The dot gains were measured using designed patterns called Brunner targets which are available from System Brunner USA, Inc., Rye, N.Y. Typically desired dot gains for graphic arts applications are in the range of 15 to 22% at midtone. The dot range was easily tested using URGA targets, Graphic Arts Technical Foundation, Pittsburgh, Pa., that include 0.5% highlight dots to 99.5% shadow dots and in a 133 lines/mm screen that includes 4 μm highlights and shadow microlines. Typically desired dot ranges for graphic arts applications are in the range of 2 to 98%.

The photohardenable electrostatic master was first exposed through a separation negative using a Douthitt Option X Exposure Unit (Douthitt Corp., Detroit, Mich.), equipped with a model TU 64 Violux®5002 lamp assembly (Exposure Systems Corp., Bridgeport, Conn.) and model No. 5027 photopolymer type lamp. Exposure times varied from 1–100 seconds depending on the formulation. The exposed master was then mounted on a drum surface. SWOP (Specification Web Offset Publications) density in the solid regions was obtained by charging the fully exposed regions of the photopolymerizable layer of the electrostatic master to 100 to 200 V. The charged latent image was then developed with a liquid electrostatic developer, using a two roller toning station and the developer layer properly metered. The developing and metering stations were placed a 5 and 6 o'clock respectively. The toner image was corona transferred onto paper using 10–150 microamps transfer corona and 4.35 to 4.88 kV, and −2.5 to −8.0 kV tackdown roll voltage at a speed of 2.2 inches/second (5.59 cm/second) and fused in an oven for 10 seconds at 100° C.

A four color proof is obtained by following the steps described below. First, complementary registration marks are cut into the photopolymerizable layers of the electrostatic masters prior to exposure. Masters for each of the four color separations are prepared by exposing four photopolymerizable elements having coversheets to one of the four color separation negatives corresponding to cyan, yellow, magenta and black colors. Each of the four photopolymerizable layers is exposed for about 3 seconds using the Douthitt Option X Exposure Unit described above. The visible radiation emitted by this source is suppressed by a UV light transmitting, visible light absorbing Kokomo® glass filter (No. 400, Kokomo Opalescent Glass Co., Kokomo, Ind.). The cover sheets are removed, and each master is mounted on the corresponding color module drum, in a position assuring image registration of the four images as they are sequentially transferred from each master to the receiving paper. The leading edge clamps are also used to ground the backplane of the electrically conductive substrate to the drum. The masters are stretched by spring loading the trailing edge assuring that each lays flat against its drum.

Each module comprised a charging scorotron at 3 o'clock position, a developing station at 6 o'clock, a metering station at 7 o'clock and a cleaning station at 9 o'clock. The charging, developing, and metering procedure is similar to that described above. The transfer station consists of a tackdown roll, a transfer corona, paper loading, and a positioning device that fixes the relative position of paper and master in all four transfer operations.

In the preparation of the four-color proof the four developers, or toners, have the following compositions:

| INGREDIENTS | AMOUNT (g) |
|---|---|
| BLACK | |
| Copolymer of ethylene (89%) and methacrylic acid (11%), melt index at 190° C. is 100, acid no. is 66 | 2,193.04 |
| Sterling NF carbon black | 527.44 |
| Heucophthal Blue, G XBT-583D Heubach, Inc., Newark, NJ | 27.76 |
| Basic Barium Petronate®, Witco Chemical Corp., New York, NY | 97.16 |
| Aluminum tristearate, Witco 132 Witco Chemical Corp., New York, NY | 27.76 |
| Isopar®-L, non-polar liquid having a Kauri-Butanol value of 27, Exxon Corporation | 188,670.0 |
| CYAN | |
| Copolymer of ethylene (89%) and methacrylic acid (11%), melt index at 190° C. is 100, acid no. is 66 | 3,444.5 |
| Ciba-Geigy Monarch Blue X3627 | 616.75 |
| Dalamar® Yellow YT-858D Heubach, Inc., Newark, NJ | 6.225 |
| Aluminum tristearate, as described in black developer | 83.0 |
| Basic Barium Petronate® (Witco Chemical Corp.) | 311.25 |
| Isopar®-L as described in black developer | 292,987.0 |
| MAGENTA | |
| Copolymer of ethylene (89%) and methacrylic acid (11%), melt index at 190° C. is 100, acid no. is 66 | 3973.47 |
| Mobay RV-6700, Mobay Chemical Corp., Haledon, NJ | 1156.66 |
| Mobay RV-6713, Mobay Chemical Corp. Haledon, NJ | 204.12 |
| Aluminum stearate S, Witco Chemical Corp. | 108.86 |
| Basic Barium Petronate®, Witco Chemical Corp. | 326.58 |
| Isopar®-L as described in black developer | 378,876.0 |
| YELLOW | |
| Copolymer of ethylene (89%) and methacrylic acid (11%), melt index at 190° C. is 100, acid no. is 66 | 1,824.75 |
| Yellow 14 polyethylene flush, Sun Chemical Co., Cincinnati, OH | 508.32 |
| Aluminum tristearate, as described in black developer | 46.88 |
| Basic Barium Petronate®, Witco Chemical Corp. | 59.5 |
| Isopar®-L as described in black developer | 160,191.0 |

First, the cyan master is charged, developed and metered. The transfer station is positioned and the toned cyan image transferred onto the paper. After the cyan transfer is completed, the magenta master is corona charged, developed and metered, and the magenta image transferred, in registry, on top of the cyan image. Afterwards, the yellow master is corona charged, developed, and metered, and the yellow image is transferred on top of the two previous images. Finally the black master is corona charged, developed, metered, and the toned black image transferred, in registry, on top of the three previously transferred images. After the procedure is completed, the paper is carefully removed from the transfer station and the image fused for 15 seconds at 100° C.

The parameters used for preparation of the proof are: drum speed, 2.2 inches/second (5.588 cm/second); grid scorotron voltage, 100 to 400 V; scorotron current 200 to 1000 microamps (5.11 to 6.04 kV); metering roll voltage, 20 to 200 V; tackdown roll voltage, −2.5 to −8.0 kV; transfer corona current, 10 to 150 microamps (4.35 to 4.88 kV); metering roll speed, 4 to 8 inches/-second (10.16 to 20.32 cm/second.); metering roll gap, 0.002 to 0.005 inch (0.51 to 0.0127 mm); developer conductivity 12 to 30 picomhos/cm; developer concentration, 1 to 2.0% solids.

To test for backtransfer, the exposed element was mounted on a drum surface. The charged latent image was developed with the magenta toner used in the preparation of the four-color proof. The charging corona voltage and current were adjusted to give SWOP density in the solid areas. Standard conditions were 200 to 300 V in the scorotron grid, 550 uA charging corona current.

After the transfer of the first image was completed, the photohardenable element (electrostatic master) was tested for backtransfer latitude in three sequential charging, developing and transfer cycles as follows: the paper, with a wet image on top, was carefully placed in the transfer position. The leading edge of the photohardenable element and the wet image on paper were aligned one inch (2.54 cm) apart and with both the leading and trailing edges of the paper held away from the photohardenable element. The electrostatic master was cleaned and the second charging, developing and transferring cycle started. A second toner layer on top of the original image was thus obtained. The second image transfer efficiency and the extent of backtransfer of the previous image were evaluated by an operator standing near the exit of the transfer zone. After the second transfer was completed the procedure was repeated a third and a fourth time always checking for backtransfer. These four passes simulate the actual making of a four-color proof in which the image first developed is subjected to the transfer field three more times before the proof is completed. The above procedure was repeated for at least two transfer conditions where the transfer corona current varied from 10 to 50 microamps and the tackdown roll voltage from −2.5 to −8.0 kV (standard conditions: 30 uA and −3.0 kV). The presence of acidic additives in the photohardenable layer as illustrated in the following examples alleviated backtransfer under a wide range of operating conditions. A photohardenable layer that would not backtransfer under these conditions should be suitable as an electrostatic master in a multiple color system.

EXAMPLE 1

Solutions of photopolymerizable compositions were prepared containing 80 parts of methylene chloride and 20 parts of solids. The solids comprised monomer or combination of monomers, binder or combinations of binders, initiator, acidic additive and chain transfer agent. The solutions were coated on 0.004 inch (0.0102 cm) aluminized polyethylene terephthalate support and a 0.00075 inch (0.001905 cm) polypropylene cover sheet was present. The coating weights varied from 80 to 150 mg/cm$^2$ or an approximate thickness of 7 μm to 12 μm in sample thickness.

The photopolymerizable layer for each element had the following composition wherein the amounts are in parts.

TABLE 1

| | COMPOSITIONS (PARTS) | | | | | | | | | | | | | | |
|---|---|---|---|---|---|---|---|---|---|---|---|---|---|---|---|
| SAMPLE | B1 | M1 | IN1 | CT1 | A3 | A4 | A5 | A6 | A7 | A8 | A10 | A12 | A13 | A14 | A15 |
| 1* | 58 | 28 | 5 | 3 | | | | | | | | | | | |
| 2 | 58 | 28 | 5 | 3 | | | | | 4 | | | | | | |
| 3 | 58 | 28 | 5 | 3 | | 3 | | | | | | | | | |
| 4 | 58 | 28 | 5 | 3 | 3 | | | | | | | | | | |
| 5 | 58 | 28 | 5 | 3 | | | 4 | | | | | | | | |
| 6 | 58 | 28 | 5 | 3 | | | | 4 | | | | | | | |
| 7 | 58 | 28 | 5 | 3 | | | | | | 4 | | | | | |
| 8 | 58 | 28 | 5 | 3 | | | | | | | 4 | | | | |
| 9 | 58 | 28 | 5 | 3 | | | | | | | | 4 | | | |
| 10 | 58 | 28 | 5 | 3 | | | | | | | | | 4 | | |
| 11 | 58 | 28 | 5 | 3 | | | | | | | | | | 3 | |
| 12 | 58 | 28 | 5 | 3 | | | | | | | | | | | 3 |

All contain 0.03 part of S1 and 3 parts LD1.
*Control
Results are shown in Table 2 below.

TABLE 2

| | BACKTRANSFER | | | | | | | | |
|---|---|---|---|---|---|---|---|---|---|
| SAM- | 10 uA, −2.5 kV | | | 30 uA, −3.5 kV | | | 50 uA, −4.5 kV | | |
| PLE | 1st | 2nd | 3rd | 1st | 2nd | 3rd | 1st | 2nd | 3rd |
| 1* | Y | Y | Y | Y | Y | Y | Y | Y | Y |
| 2 | N | N | N | N | N | N | N | L | L |
| 3 | N | N | L | N | N | L | N | N | L |
| 4 | N | L | L | L | L | L | L | L | L |
| 5 | P | L | L | L | L | L | L | L | L |
| 6 | N | N | N | N | N | N | N | N | N |
| 7 | L | L | L | N | N | N | L | L | L |
| 8 | N | N | N | N | N | N | N | N | N |
| 9 | N | N | N | N | N | N | N | N | N |
| 10 | N | N | N | N | N | N | N | N | N |
| 11 | N | N | N | N | N | N | N | N | N |
| 12 | N | N | N | N | N | N | N | N | N |

*Control
The abbreviations are defined below:
1st is the second image transferred.
2nd is the third image transferred.
3rd is the fourth image transferred.
N is substantially no backtransfer.
L is low backtransfer.
Y is fair backtransfer.
P is poor transfer efficiency.

EXAMPLE 2

Thirteen photopolymerizable elements were prepared and tested as described in Example 1 with the following exceptions: the photopolymerizable layer for each element had the composition shown in Table 3 below. Results are shown in Table 4 below.

TABLE 3

| SAMPLE | COMPOSITIONS (PARTS) | | | | | | | | | | | | | | | |
|---|---|---|---|---|---|---|---|---|---|---|---|---|---|---|---|---|
| | B1 | B2 | B3 | M1 | M2 | M3 | IN1 | CT1 | A3 | A4 | A7 | A9 | A11 | A12 | A17 | LD1 |
| 13* | 57 | | | 27 | | | 5 | 3 | | | | | | | | 3 |
| 14 | 57 | | | 27 | | | 5 | 3 | | 5 | | | | | | 3 |
| 15 | 57 | | | 27 | | | 5 | 3 | | | | | 8 | | | 3 |
| 16 | 57 | | | 27 | | | 5 | 3 | | | | 5 | | | | 3 |
| 17 | 57 | | | 27 | | | 5 | 3 | | | | | | | 3 | 3 |
| 18 | 57 | | | 27 | | | 5 | 3 | 5 | | | | | | | 3 |
| 19 | 57 | | | 27 | | | 5 | 3 | | | | | | 2.5 | | 3 |
| 20 | | 21 | 42 | 25 | | | 3 | 2 | | | 5 | | | | | 3 |
| 21 | 58 | | | | 20 | 9 | 3 | 3 | | | 5 | | | | | 4 |
| 22 | 58 | | | | 29 | | 3 | 3 | | | 5 | | | | | 4 |
| 23 | | 56 | | 29 | | | 3 | 3 | | | 5 | | | | | 4 |
| 24 | | | 63 | 24 | | | 3 | 3 | | | 5 | | | | | 3 |
| 25 | 59 | | | 28 | | | 3 | 2 | | | 5 | | | | | 3 |

All contain 0.03 part of TAOBN thermal inhibitor.
*Control

TABLE 4

| SAMPLE | BACKTRANSFER | | | | | |
|---|---|---|---|---|---|---|
| | 50 uA, −7.0 kV | | | 50 uA, −8.0 kV | | |
| | 1st | 2nd | 3rd | 1st | 2nd | 3rd |
| 13* | Y | Y | Y | Y | Y | Y |
| 14 | N | N | N | N | N | N |
| 15 | N | N | N | N | N | N |
| 16 | N | N | N | N | N | N |
| 17 | N | N | N | N | N | N |
| 18 | N | N | N | N | N | N |
| 19 | N | N | N | N | N | N |
| 20 | N | N | N | N | N | N |
| 21 | N | N | N | N | N | N |
| 22 | N | N | N | N | N | N |
| 23 | N | N | N | N | N | N |
| 24 | N | N | N | N | N | N |
| 25 | N | N | N | N | N | N |

*Control

EXAMPLE 3

Eight photopolymerizable elements were prepared and tested as described in Example 1 with the following exceptions: the photopolymerizable layer for each element had the composition shown in Table 5 below. Results are also shown in Table 6 below.

TABLE 5

| SAMPLE | COMPOSITIONS (PARTS) | | | | | | | | | | | |
|---|---|---|---|---|---|---|---|---|---|---|---|---|
| | B1 | M1 | IN1 | IN2 | IN3 | LD1 | LD2 | A3 | A7 | CT1 | CT2 | S1 |
| 26* | 58 | 28 | 5 | | | | | | | 3 | | 0.03 |
| 27* | 58 | 31 | 5 | | | 3 | | | | 3 | | 0.03 |
| 28 | 58 | 26 | 5 | | | 4 | | 4 | | 3 | | 0.03 |
| 29 | 58 | 29 | 5 | | | 2.5 | | 2.5 | | 3 | | 0.03 |
| 30 | 59 | 29 | | 5 | | 3 | | | 4 | | | |
| 31 | 59 | 29 | | | 5 | 3 | | | 4 | | | |
| 32 | 59 | 28 | 3 | | | | 3 | | 5 | | 3 | |
| 33 | 58 | 27 | 5 | | | | 3 | 4 | | 3 | | |

*Controls

TABLE 6

| SAMPLE | BACKTRANSFER | | | | | | | | |
|---|---|---|---|---|---|---|---|---|---|
| | 30 uA, −3.5 kV | | | 50 uA, −5.0 kV | | | 50 uA, −7.0 kV | | |
| | 1st | 2nd | 3rd | 1st | 2nd | 3rd | 1st | 2nd | 3rd |
| 26* | L | L | L | Y | Y | Y | Y | Y | Y |
| 27* | L | L | Y | L | L | Y | Y | Y | Y |
| 28 | N | N | N | N | N | N | N | N | N |
| 29 | N | N | N | N | N | N | N | N | N |
| 30 | N | N | N | N | N | N | N | N | N |
| 31 | N | N | N | N | N | N | N | N | N |
| 32 | N | N | N | N | N | N | N | N | N |
| 33 | N | N | N | N | N | N | N | N | N |

*Controls

EXAMPLE

Sixteen photopolymerizable elements (seven controls) were prepared and tested as described in Example 1 with the following exceptions: the photopolymerizable layer for each element had the composition shown in Table 7 below. Results are shown in Table 8 below.

TABLE 7

| SAMPLE | COMPOSITIONS (PARTS) | | | | | | | | | | | | | | |
|---|---|---|---|---|---|---|---|---|---|---|---|---|---|---|---|
| | B1 | B2 | B3 | M1 | M2 | M3 | IN1 | CT1 | LD1 | A4 | A7 | A10 | A14 | A1 | A2 |
| 34* | | 21 | 42 | | 17 | 6 | 4 | 3 | 3 | | | | | | |
| 35 | | 21 | 42 | | 17 | 6 | 4 | 3 | 3 | 4 | | | | | |
| 36 | | 21 | 42 | | 17 | 6 | 4 | 3 | 3 | | 4 | | | | |
| 37* | 46 | | 16 | | 17 | 7 | 4 | 3 | 3 | | | | | | |
| 38 | 46 | | 16 | | 17 | 7 | 4 | 3 | 3 | 4 | | | | | |
| 39* | 58 | | | 29 | | | 5 | 3 | | | | | | | |
| 40 | 58 | | | 29 | | | 5 | 3 | | | 5 | | | | |
| 41 | 58 | | | 29 | | | 5 | 3 | | 5 | | | | | |
| 42 | 58 | | | 29 | | | 5 | 3 | | | | 5 | | | |
| 43 | 58 | | | 29 | | | 5 | 3 | | | | | 4 | | |
| 44* | 58 | | | 28 | | | 5 | 3 | 3 | | | | | | |
| 45* | 58 | | | 29 | | | 5 | 3 | 3 | | | | | 3 | |

TABLE 7-continued

| SAMPLE | COMPOSITIONS (PARTS) | | | | | | | | | | | | | | |
|---|---|---|---|---|---|---|---|---|---|---|---|---|---|---|---|
| | B1 | B2 | B3 | M1 | M2 | M3 | IN1 | CT1 | LD1 | A4 | A7 | A10 | A14 | A1 | A2 |
| 46* | 58 | | | 29 | | | 5 | 3 | 3 | | | | | 6 | |
| 47* | 58 | | | 29 | | | 5 | 3 | 3 | | | | | | 4 |
| 48 | 58 | | | 29 | | | 5 | 3 | 3 | | | | 4 | | |
| 49 | 58 | | | 29 | | | 5 | 3 | 3 | | 4 | | | | |

*Controls

TABLE 8

| SAMPLE | BACKTRANSFER | | | | | |
|---|---|---|---|---|---|---|
| | 30 uA, −3.0 kV | | | 50 uA, −7.0 kV | | |
| | 1st | 2nd | 3rd | 1st | 2nd | 3rd |
| 34* | Y | Y | Y | Y | Y | Y |
| 35 | N | N | N | N | N | N |
| 36 | N | N | N | N | N | L |
| 37* | Y | Y | Y | L | Y | Y |
| 38 | N | N | N | N | N | N |
| 39* | Y | Y | Y | Y | Y | Y |
| 40 | N | N | N | L | L | L |
| 41 | N | N | N | L | L | L |
| 42 | N | N | N | L | L | L |
| 43 | N | N | N | L | L | L |
| 44* | Y | Y | Y | L | Y | Y |
| 45* | L | L | Y | Y | Y | Y |
| 46* | L | L | Y | Y | Y | Y |
| 47* | L | L | Y | Y | Y | Y |
| 48 | N | N | N | N | N | N |
| 49 | N | N | N | N | N | N |

*Controls

EXAMPLE 5

Seven photopolymerizable elements were prepared and tested as described in Example 1 with the following exceptions: the photopolymerizable layer for each element had the composition shown in Table 9 below. Results are shown in Table 10 below illustrating usefulness of mixtures of acidic additives.

TABLE 9

| SAMPLE | COMPOSITIONS (PARTS) | | | | | | | | |
|---|---|---|---|---|---|---|---|---|---|
| | B1 | M1 | IN1 | CT1 | A3 | A8 | A12 | A14 | A17 |
| 50* | 58 | 28 | 5 | 3 | | | | | |
| 51 | 58 | 28 | 5 | 3 | 6 | | | | |
| 52 | 58 | 28 | 5 | 3 | 3 | | 1.5 | | |
| 53 | 58 | 28 | 5 | 3 | 3 | | 3 | | |
| 54 | 58 | 28 | 5 | 3 | | 3 | | 1 | |
| 55 | 58 | 28 | 5 | 3 | | | | | 4 |
| 56 | 58 | 58 | 5 | 3 | | | | 3 | 3 |

*Control

TABLE 10

| SAMPLE | BACKTRANSFER | | | | | | | | |
|---|---|---|---|---|---|---|---|---|---|
| | 30 uA, −3.0 kV | | | 30 uA, −5.0 kV | | | 50 uA, −7.0 kV | | |
| | 1st | 2nd | 3rd | 1st | 2nd | 3rd | 1st | 2nd | 3rd |
| 50* | Y | Y | Y | Y | Y | Y | Y | Y | Y |
| 51 | N | N | N | N | N | N | L | L | L |
| 52 | N | N | N | N | N | N | L | L | L |

TABLE 10-continued

| SAMPLE | BACKTRANSFER | | | | | | | | |
|---|---|---|---|---|---|---|---|---|---|
| | 30 uA, −3.0 kV | | | 30 uA, −5.0 kV | | | 50 uA, −7.0 kV | | |
| | 1st | 2nd | 3rd | 1st | 2nd | 3rd | 1st | 2nd | 3rd |
| 53 | N | N | N | N | N | N | L | N | N |
| 54 | N | N | N | N | N | N | N | N | N |
| 55 | N | N | N | L | L | L | L | L | L |
| 56 | N | N | N | N | N | N | L | L | L |

*Control

EXAMPLE 6

This example illustrates the use of the photohardenable electrostatic master to prepare a four color proof. The following composition was prepared from the indicated ingredients in parts:

| B2 | B3 | M2 | M3 | INI | CT1 | LDI | A4 | S2 | S1 |
|---|---|---|---|---|---|---|---|---|---|
| 21.4 | 44.3 | 16.4 | 6.5 | 3 | 2 | 3 | 3 | 0.5 | 0.3 |

After the solution was stirred for 24 hr to properly dissolve all the components, it was coated onto aluminized polyethylene terephthalate at 100 ft/min (30.48 m/min) coating speed. Coating weight was 130 mg/dm$^2$. A polypropylene cover sheet was placed on the photopolymer surface immediately after drying. The material thus formed was cut into four pieces about 31 inches by 26 inches (78.7 cm by 66.0 cm) for preparation of a four color proof.

A four color proof was obtained by following the general procedure for making a four color proof outlined above using cyan, magenta, yellow and black photohardenable electrostatic masters.

EXAMPLE 7

Five photopolymerizable elements were prepared as described in Example 1 and tested for adhesion to the substrate using an Instron peel test which measures the force needed to peel the photopolymerizable layer from the substrate. Table 11 below shows the composition of each photopolymerizable element and the peel forces. Larger peel force indicates greater adhesion to the substrate. Samples 57 and 59 containing the sulfonamides (A4) showed significantly better adhesion than Samples 58, 60 and 61 which had p-toluenesulfonic acid (TSA) and triphenylamine (TPA) in the compositions.

TABLE 11

| SAMPLE | COMPOSITIONS (PARTS) AND ADHESION | | | | | | | | | | | | | |
|---|---|---|---|---|---|---|---|---|---|---|---|---|---|---|
| | B1 | B2 | B3 | M2 | M3 | IN1 | CT1 | LD1 | A4 | TSA | S2 | TPA | S1 | Peel Force* |
| 57 | | | 67.2 | 17.3 | 4.6 | 3 | 2 | 2.4 | 3 | | 0.5 | | 0.03 | 16.4 |
| 58 | | | 65.1 | 16.8 | 4.2 | 3 | 2 | 2.4 | | 2 | 0.5 | 4 | 0.03 | 7.3 |
| 59 | | 16.6 | 49.7 | 18.2 | 4.6 | 3 | 2 | 2.4 | 3 | | 0.5 | | 0.03 | 13.3 |
| 60 | | 15.9 | 47.6 | 18.1 | 4.5 | 3 | 2 | 2.4 | | 2 | 0.5 | 4 | 0.03 | 7.8 |
| 61 | 43.8 | | 15.5 | 17.2 | 8.1 | 4 | 2 | 3 | | 3 | 0.3 | 3.2 | 0.03 | 4.5 |

*Instron peel test, in grams force/linear inch.

An Instron Tensile Tester, Model 1130 with 500 g load cell, and Microcon 1 unit from Instron Corp., Canton, Mass. was used in testing the adhesion of a photohardenable layer to the conductive substrate. Unexposed film samples were cut in 1 inch (2.54 cm)×10.25 inch (26.04 cm) strips. The cover sheet of the photohardenable element was removed and a piece of one-inch (2.54 cm) wide transparent Scotch tape (3M Company, Minneapolis, Minn.) was securely and smoothly attached to the entire coated side of the film. Approximately one inch (2.54 cm) of the tape plus coating was peeled from the substrate (aluminized Mylar® film) and the end of the uncoated substrate was placed into the top clamp. The free end of the tape was folded onto itself to form a tab which was then placed into the bottom clamp. As the crosshead moved upward (at 20 inches (50.8 cm) per minute) the photohardenable layer was delaminated from the substrate and the peel force required for the delamination was measured which reflected the adhesion of the photohardenable layer to the substrate. Five specimens were tested on each sample. The average peel forces for Sample 57 to 61 are shown in Table 11.

What is claimed is:

1. A high resolution, photohardenable electrostatic master comprising:

(1) an electrically conductive substrate bearing (2) a layer of photohardenable composition consisting essentially of (a) at least one organic polymeric binder, (b) at least one compound having at least one ethylenically unsaturated group, (c) a photoinitiator or photoinitiator system that activates polymerization of the ethylenically unsaturated compound upon exposure to actinic radiation, and (d) an acidic additive selected from the group consisting essentially of:

(1) compounds of the general formula:

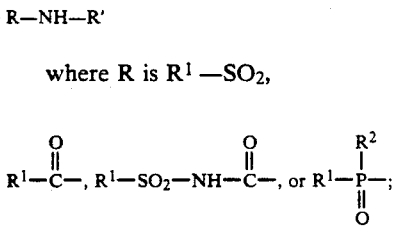

where R is $R^1—SO_2$, where $R^1$ is alkyl of 1 to 12 carbon atoms, aryl of 6 to 30 carbon atoms, substituted alkyl, substituted aryl, halogen or heterocyclic groups;

R and R′ when taken together may form a heterocyclic ring; $R^1$, $R^2$ and $R^3$ may be the same or different and are alkyl of 1 to 12 carbon atoms, aryl of 6 to 30 carbon atoms, substituted alkyl, substituted aryl, acyl, halogen or heterocyclic groups;

(2) phosphonic acids of the general formula:

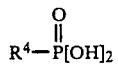

where $R^4$ is alkyl of 1 to 12 carbon atoms, aryl of 6 to 30 carbon atoms, substituted alkyl, substituted aryl, halogen or heterocyclic groups; and (3) polybasic carboxylic acids having at least two acid groups.

2. A photohardenable electrostatic master according to claim 1 wherein the acid additive (1) is of the formula: $R^1—SO_2—NH—R'$ where $R^1$ is alkyl of 1 to 12 carbon atoms, aryl of 6 to 30 carbon atoms, substituted alkyl and substituted aryl; R′ is H, acyl, alkyl of 1 to 12 carbon atoms, aryl of 6 to 30 carbon atoms, substituted alkyl or substituted aryl.

3. A photohardenable electrostatic master according to claim 2 wherein the acidic additive represented by the formula is a sulfonamide.

4. A photohardenable electrostatic master according to claim 3 wherein the acidic additive is a mixture of o- and p-toluenesulfonamide.

5. A photohardenable electrostatic master according to claim 3 wherein the acidic additive is alpha-toluenesulfonamide.

6. A photohardenable electrostatic master according to claim 3 wherein the acidic additive is p-(p-toluenesulfonamido) diphenylamine.

7. A photohardenable electrostatic master according to claim 2 wherein the acidic additive represented by the formula is a sulfonimide.

8. A photohardenable electrostatic master according to claim 7 wherein the acidic additive is benzoic sulfonimide.

9. A photohardenable electrostatic master according to claim 1 wherein the acidic additive is a sulfonylurea.

10. A photohardenable electrostatic master according to claim 1 wherein the acidic additive (1) is of the formula:

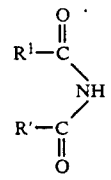

wherein $R^1$ and R′ may be the same or different and are alkyl of 1 to 12 carbon atoms, aryl of 6 to 30 carbon atoms, substituted alkyl, substituted aryl, heterocyclic 5- or 6-membered rings, and $R^1$ and R′ when taken together may form heterocyclic 5- or 6-membered rings or condensed rings.

11. A photohardenable electrostatic master according to claim 10 wherein the acidic additive is a phthalimide.

12. A photohardenable electrostatic master according to claim 10 wherein the acidic additive is a diacetamide.

13. A photohardenable electrostatic master according to claim 10 wherein the acid additive of the formula is a heterocyclic 5- or 6-membered ring or condensed ring.

14. A photohardenable electrostatic master according to claim 13 wherein the acidic additive is parabanic acid.

15. A photohardenable electrostatic master according to claim 1 wherein the acidic additive (1) is of the formula:

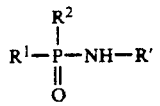

wherein $R^1$, $R'$, $R^2$ may be the same or different and are alkyl of 1 to 12 carbon atoms, aryl of 6 to 30 carbon atoms, substituted alkyl, substituted aryl, halogen, or heterocyclic 5- or 6-membered rings.

16. A photohardenable electrostatic master according to claim 15 wherein the acidic additive is phenyl N-phenylphosphonamido chloridate.

17. A photohardenable electrostatic master according to claim 1 wherein the acidic additive (2) is of the formula:

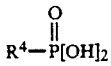

where $R^4$ is alkyl of 1 to 12 carbon atoms, aryl of 6 to 30 carbon atoms, substituted alkyl, substituted aryl, halogen or heterocyclic groups.

18. A photohardenable electrostatic master according to r claim 17 wherein the acidic additive is benzene phosphonic acid.

19. A photohardenable electrostatic master according to claim 1 wherein the acidic additive (3) is of the formula $HO_2C—R^5—CO_2H$ wherein $R^5$ is aliphatic of 0 to 12 carbon atoms which can be saturated or unsaturated, substituted or unsubstituted; aryl of 6 to 30 carbon atoms, substituted alkyl or substituted aryl.

20. A photohardenable electrostatic master according to claim 19 wherein the acidic additive is phthalic acid.

21. A photohardenable electrostatic master according to claim 19 wherein the acidic additive is maleic acid.

22. A photohardenable electrostatic master according to claim 19 wherein the acidic additive is diphenic acid.

23. A photohardenable electrostatic master according to claim 1 wherein a chain transfer agent is present.

24. A photohardenable electrostatic master according to claim 23 wherein a chain transfer agent is 2-mercaptobenzoxazole.

25. A photohardenable electrostatic master according to claim 23 wherein the binder (a) is polymethyl methacrylate, ethylenically unsaturated compound (b) is ethoxylated trimethylol propane triacrylate, photoinitiator or photoinitiating system (c) is 2,2',4,4'-tetrakis(o-chlorophenyl)-5,5'-bis(m,p-dimethoxyphenyl)-biimidazole, acidic additive (d) is a mixture of o-and p-toluene sulfonamide, and the chain transfer agent is 2-mercaptobenzoxazole.

26. A photohardenable electrostatic master according to claim 23 wherein the binder (a) is polymethyl methacrylate, ethylenically unsaturated compound (b) is ethoxylated trimethylol propane triacrylate, photoinitiator or photoinitiating system (c) is 2,2',4,4'-tetrakis(o-chlorophenyl)-5,5'-bis(m,p-dimethoxyphenyl)-biimidazole, acidic additive (d) is benzoic sulfonimide, and the chain transfer agent is 2-mercaptobenzothiazole.

27. A photohardenable electrostatic master according to claim 1 wherein the binder (a) is selected from the group consisting of acrylate and methacrylate polymers and copolymers, vinyl polymers and copolymers, polyvinyl acetals, polycarbonates, polysulfones, polyetherimides, polyphenylene oxides, polyesters, polyurethanes, butadiene copolymers, cellulose esters and cellulose ethers.

28. A photohardenable electrostatic master according to claim 1 wherein the polymeric binder (a) is a mixture of a polymeric binder having a Tg greater than 80° C. and a polymeric binder with a Tg less than 70° C.

29. A photohardenable electrostatic master according to claim 28 wherein the binder having a Tg greater than 80° C. is selected from the group consisting of acrylate and methacrylate polymers and copolymers, vinyl polymers and copolymers, polyvinyl acetals, polycarbonates, polysulfones, polyetherimides, and polyphenylene oxides.

30. A photohardenable electrostatic master according to claim 29 wherein the binder is poly(styrene/methyl methacrylate).

31. A photohardenable electrostatic master according to claim 28 wherein the binder with a Tg less than 70° C. is selected from the group consisting of acrylate and methacrylate polymers and copolymers, vinyl polymers and copolymers, polyvinyl acetals, polyesters, polyurethanes, butadiene copolymers, cellulose esters and cellulose ethers.

32. A photohardenable electrostatic master according to claim 31 wherein the binder is poly(ethyl methacrylate).

33. A photohardenable electrostatic master according to claim 1 wherein a monomeric compound (b) having ethylenic unsaturation is an acrylate or methacrylate compound having at least two terminal ethylenically unsaturated groups.

34. A photohardenable electrostatic master according to claim 33 wherein compound (b) is glycerol propoxylated triacrylate.

35. A photohardenable electrostatic master according to claim 1 wherein the at least one compound (b) is a mixture of glycerol propoxylated triacrylate and trimethylolpropane triacrylate.

36. A photohardenable electrostatic master according to claim 1 wherein the photoinitiator (c) is a 2,4,5triphenylimidazolyl dimer.

37. A photohardenable electrostatic master according to claim 36 wherein the photoinitiator is 2,2',4,4'-tetrakis(o-chlorophenyl)-5,5'-bis(m,p-dimethoxyphenyl)-biimidazole.

38. A photohardenable electrostatic master according to claim 36 wherein the photoinitiator is 2,2'-bis(o-chlorophenyl)-4,4',5,5'-bis(m-methoxyphenyl)-biimidazole.

39. A photohardenable electrostatic master according to claim 36 wherein a chain transfer agent is present.

40. A photohardenable electrostatic master according to claim 39 wherein the chain transfer agent is 2-mercaptobenzoxazole.

41. A photohardenable electrostatic master according to claim 39 wherein the chain transfer agent is 2-mercaptobenzothiazole.

42. A photohardenable electrostatic master according to claim 1 wherein the photoinitiator (c) is a substituted or unsubstituted polynuclear quinone.

43. A photohardenable electrostatic master according to claim 42 wherein the photoinitiator is 2-ethylanthraquinone.

44. A photohardenable electrostatic master according to claim 1 wherein the photoinitiator (c) is a benzoin ether.

45. A photohardenable electrostatic master according to claim 44 wherein the photoinitiator is benzoin methyl ether.

46. A photohardenable electrostatic master according to claim 1 wherein a sensitizer compound is present.

47. A photohardenable electrostatic master according to claim 46 wherein the sensitizer compound is 2-{9'-(2',3',6',7'-tetrahydro-lH,5H-benzo[i,j]-quinolyidene))-5,6-dimethoxy-1-indanone.

48. A photohardenable electrostatic master according to claim 1 wherein the layer of photohardenable composition in combination with component (d) contains (a) a binder selected from the group of poly(styrene/-methylmethacrylate) and poly(methyl methacrylate), (b) a monomeric compound selected from the group consisting of glycerol propoxylated triacrylate, trimethylol propane triacrylate and mixtures thereof, and (c) 2,2',4,4'-tetrakis(o-chlorophenyl)-5,5'-bis(m,p-dimethoxyphenyl)biimidazole, and 2-mercaptobenzoxazole as a chain transfer agent.

49. A photohardenable electrostatic master according to claim 1 wherein the layer of photohardenable composition has present the following components: polymeric binder (a), 40 to 70% by weight, compound (b), 15 to 40% by weight, the photoinitiator (c), 1 to 20% by weight, and acidic additive (d), 1 to 10% by weight, the weight percentages being based on the total weight of the photohardenable composition.

* * * * *